United States Patent [19]

Wade

[11] Patent Number: 4,800,616

[45] Date of Patent: Jan. 31, 1989

[54] AIR POWERED DUCT CLEANER AND CRAWLER

[75] Inventor: Calvin N. Wade, Forth Worth, Tex.

[73] Assignee: Steamatic, Inc., Grand Prairie, Tex.

[21] Appl. No.: 191,210

[22] Filed: May 6, 1988

[51] Int. Cl.[4] ..... A47L 9/02

[52] U.S. Cl. ..... 15/379; 15/387; 15/395; 15/396; 15/405

[58] Field of Search ..... 15/379, 387, 395, 396, 15/405

[56] References Cited

U.S. PATENT DOCUMENTS

| | | | |
|---|---|---|---|
| 1,580,294 | 4/1926 | Gawley | 15/387 X |
| 1,869,730 | 8/1932 | Antle | 15/395 X |
| 2,338,339 | 1/1944 | Mere et al. | 15/387 X |
| 3,803,658 | 4/1974 | Raubenheimer | 15/379 X |
| 3,872,533 | 3/1975 | Proffitt | 15/387 X |
| 3,946,459 | 3/1976 | Armstrong | 15/395 X |

*Primary Examiner*—Chris K. Moore
*Attorney, Agent, or Firm*—Arthur F. Zobal

[57] ABSTRACT

The cleaning apparatus is formed by a housing member adapted to be inserted into an air duct and which has two spaced apart ports for providing an air flow path through the housing member. A flexible hose has one end coupled to one of the ports and is employed for moving the housing member in the air duct and for providing a passage for the flow of air from or to the housing member. A turbine formed by blades fixedly connected to a shaft is supported within the housing member for rotation about the shaft upon passage of air through the housing member by way of the two ports. An off centered weight is coupled to the shaft for rotation with the turbine for causing the turbine and hence the housing member to vibrate upon rotation of the turbine whereby the housing member may vibrate against the inside wall of the air duct to loosen dust and other matter from in the duct and to facilitate movement of the housing member in the duct. An air blower which preferably is a vacuum apparatus is coupled to the other end of the hose for moving air through the hose and hence through the housing member by way of the two parts for causing rotation of the turbine and for removing dust and other matter from the inside of the air duct.

6 Claims, 1 Drawing Sheet

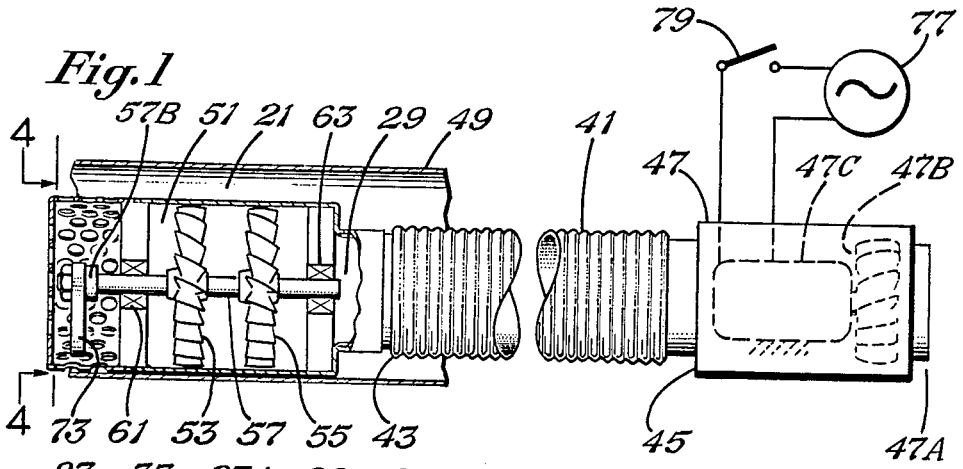
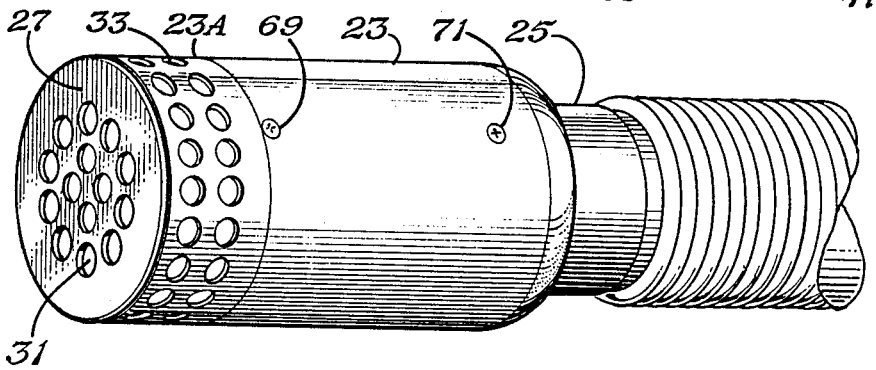
Fig.2
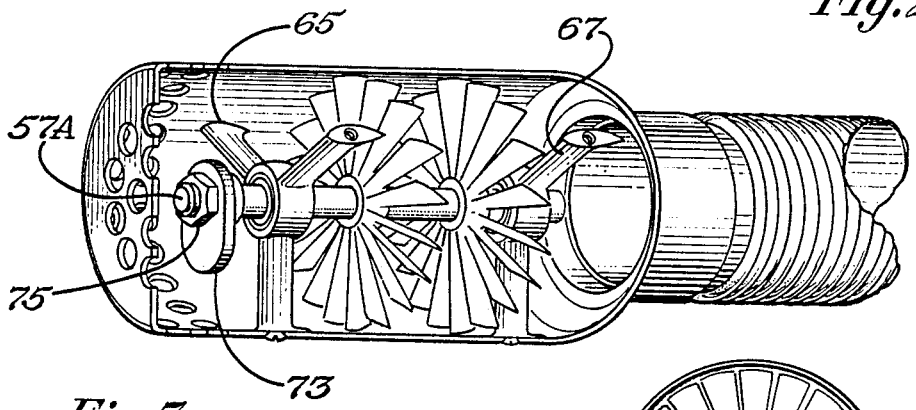
Fig.3
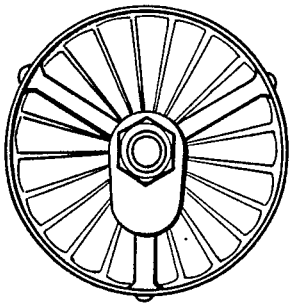
Fig.4

AIR POWERED DUCT CLEANER AND CRAWLER

BACKGROUND OF THE INVENTION

1. Field of the Invention

The invention relates to a cleaning apparatus for cleaning air ducts in houses or buildings.

2. Description of the Prior Art

The effective cleaning of air ducts in homes and buildings has presented problems in the past. A conventional vacuum hose by itself is not satisfactory for cleaning the ducts in that the use of a vacuum itself will not dislodge all of the dirt and matter from the walls of the ducts. The use of a brush on the end of a conventional vacuum hose is of some benefit, but such a combination has not been found satisfactory if the duct is larger than the brush.

U.S. Pat. Nos. 3,946,459, 982,652, and 634,270 disclose pipe and tube cleaning devices employing vibrators; however, they have disadvantages for the following reasons. The device of U.S. Pat. No. 3,946,459 requires a separate source for operating the vibrator and brush and also injects a liquid into the pipe. The devices of U.S. Pat. Nos. 982,652 and 634,270 are heavy duty boiler tube cleaners which employ large weights which are impacted against the tube which would be unsatisfactory for air ducts in houses or buildings.

SUMMARY OF THE INVENTION

It is an object of the invention to provide a new and effective apparatus for cleaning air ducts or other conduits.

The apparatus comprises a housing means adapted to be inserted into an air duct and which has first and second spaced apart ports for providing an air flow path through the housing means. A flexible hose has an end coupled to said first port for use for moving the housing means in the duct and for providing a passage for the flow of air between said first port and the other end of the hose. Turbine means is supported within the housing means for rotation about an axis upon passage of air through the housing means by way of the two ports. Weight means is coupled to the turbine means off center from the axis for rotation with the turbine means for causing the turbine means and hence the housing means to vibrate upon rotation of the turbine means whereby the housing means may vibrate against the inside wall of the air duct to loosen dust and other matter in the duct and to facilitate movement of the housing means in the duct.

In a further embodiment, an air blower means is coupled to the other end of the hose for moving air through the hose and hence through the housing means by way of the two ports for causing rotation of the turbine means.

In the preferred embodiment, the air blower means comprises a vacuum means for reducing the pressure within the hose for causing air to flow through the housing means by way of said second and first ports and then through the hose for removing dust and other matter loosened in the duct.

BRIEF DESCRIPTION OF THE DRAWINGS

FIG. 1 schematically illustrates the invention with its housing member, being partially shown in cross-section.

FIG. 2 is an isometric view of the forward end of the housing member of the apparatus of FIG. 1.

FIG. 3 is a partial cross-section shown in isometric form of the housing member of FIG. 2.

FIG. 4 is a view of FIG. 1 taken along the lines IV—IV thereof with the wall of the air duct omitted.

DETAILED DESCRIPTION OF THE PREFERRED EMBODIMENT

Referring to the drawings, the cleaning apparatus of the invention comprises a housing member 21 formed by an outer cylindrical shaped wall 23 having a reduced diameter rear end 25 and a forward portion 23A with a flat forward wall 27 which are removably coupled to the cylindrical wall by means not shown. The reduced diameter end 25 has an opening 29 extending into the housing 21 and the flat wall 27 and the forward portion 23A have apertures 31 and 33 formed therethrough providing an air flow path through the housing by way of the apertures 31, 33 and the opening 29. A flexible hose 41 has a first end 43 coupled to the reduced diameter end 25 and an opposite end 45 coupled to an electrically operated air blower 47 having an air port 47A. The hose 41 is provided for use for moving the housing member 21 in an air duct 49 and for providing a passage for the flow of air between the opening 29 of the housing member 21 and the other end 45 of the hose.

A turbine 51 comprising a shaft 57 having blades 53 and 55 fixedly secured thereto is supported in the housing member 21 for rotation by bearings 61 and 63. The bearings 61 and 63 are supported in the housing member 21 by spokes 65 and 67 which are secured to the inside of the housing member by way of screws 69 and 71. The forward end of the shaft 57 has a weight 73 secured thereto by a nut 75. The weight 73 has an aperture formed therethrough. The threaded end 57A of the shaft 57 is inserted through the aperture until the weight 73 engages a stop member 57B secured to the shaft 57. The nut 75 then screwed the threaded end 57A to secure the weight 73 in place to the shaft 57. Most of the mass of the weight 73 is located off center from the axis of the shaft 57. Upon the passage of air through the hose 41, air passes through the housing member by way of ports 31, 33 and 29 causing the blades 53 and 55 to rotate thereby rotating the shaft 57 which in turn rotates the off center weight 73. This causes the turbine 51 to vibrate and hence the housing member 21 to vibrate against the inside of the duct 49 to loosen dirt, dust and other matter. The vibration caused by the off-center weight also allows the housing member to move easily forward or backward in the duct according to the wishes of the operator causing a crawling motion through the duct.

In the preferred embodiment, the air blower 47 is an electrically operated vacuum apparatus comprising fan blades 47B driven by an electric motor 47C operated from an AC power source 77 when the switch 79 is closed. This causes the pressure in the hose 41 to be reduced, causing air to flow through the housing member by way of ports 31, 33 and 29 and through the hose 41 from its end 43 to its end 45 and through the vacuum apparatus and out the port 47A thereby removing dust and other matter from the duct. Upon flow of air through the housing member and the hose, the air causes the turbine to rotate thereby rotating the off centered weight 73 which causes the turbine and hence the housing member 21 to vibrate against the inside of the air duct to loosen dust and other matter which then is removed from the air duct by way of the air flow caused by the reduced pressure in the hose whereby the loosened dust and other matter is removed from the air duct.

The apparatus of the invention may operate effectively in an air duct which is round or rectangular in cross-section. In one embodiment, the housing member 21 has an outside diameter of 3¼ inches and a length of 9¾ inches. The weight 73 may be formed of iron and have a length of 1½ inches a width of 1 inch and a thickness of ¼ inch. The center of the aperture formed through the weight 73 for receiving the shaft 75 may be located 5/16 inches from one end of the weight and 1 3/16 inches from the other end of the weight along its length. The shaft 57 may be formed of iron having a diameter of 5/16 inches and a length of 5½ inches. The walls 23, 23A, 25 of the housing member 21 may be formed of thin metal or suitable plastic. The flexible tube 41 may be a conventional flexible tube formed of corrugated flexible plastic and it may have an inside diameter of 2 inches and a length of 50 feet. The vacuum apparatus 47 may comprise a plurality of electric motors having a total horse power of 7½ capable of drawmotors ing 40 amps and with fan blades capable of moving 300 cfm of air. The blower 47 is not shown to scale and will be much larger than shown compared to the diameter of the hose 41 and the housing member 21. It is to be understood that the apparatus of the invention may have other dimensions and operating specifications.

In the preferred embodiment, the off centered weight 73 is located within the housing, however it is to be understood that the forward end of the shaft 57 may extend through an enlarged central hole formed through the forward wall 27 and the weight 73 secured to the forward end of the shaft outside and forward of the wall 27 of the housing member 21.

I claim:

1. A cleaning apparatus, comprising:

a housing means adapted to be inserted into an air duct, said housing means having first and second spaced apart ports for providing an air flow path through said housing means, a flexible hose means having first and second ends with said first end being coupled to said first port of said housing means for use for moving said housing means in an air duct and for providing a passage for the flow of air between said first port of said housing means and said second end of said hose means, turbine means supported within said housing means for rotation about an axis upon the passage of air through said housing means by way of said first and second ports, and weight means coupled to said turbine means off center from said axis for rotation with said turbine means for causing said turbine means and hence said housing means to vibrate upon rotation of said turbine means whereby said housing means may vibrate against the inside wall of the air duct to loosen dust and other matter in the duct and to facilitate movement of the housing means in the duct.

2. The cleaning apparatus of claim 1, comprising:

air blower means coupled to said second end of said flexible hose means for causing air to flow through said flexible means hose and through said housing means by way of said first and second ports for causing said turbine means to rotate.

3. The cleaning apparatus of claim 1, wherein said turbine means comprises:

a shaft having an axis coinciding with said axis of said turbine means, blade means fixedly connected to said shaft, bearing means supporting said shaft and hence said blade means for rotation within said housing, said weight means being connected to said shaft off center from its axis.

4. The cleaning apparatus of claim 3, comprising:

air blower means coupled to the said second end of said flexible hose means for causing air to flow through said flexible hose means and through said housing means by way of said first and second ports for causing said turbine means to rotate.

5. The cleaning apparatus of claim 3, comprising:

a vacuum means coupled to said second end of said flexible hose means for reducing the pressure within said flexible hose means for causing air to flow through said housing means by way of said second and first ports and then through said flexible hose means for removing dust and other matter loosened in the air duct.

6. The cleaning apparatus of claim 1, comprising:

a vacuum means coupled to said second end of said flexible hose means for reducing the pressure within said flexible hose means for causing air to flow through said housing means by way of said second and first ports and then through said flexible hose means for removing dust and other matter loosened in the air duct.

* * * * *